US009387358B2

(12) United States Patent
Brown

(10) Patent No.: US 9,387,358 B2
(45) **Date of Patent: *Jul. 12, 2016**

(54) SURFBOARD REPLICATING BALANCE BOARD SYSTEM

(71) Applicant: Goofboard Products, LLC., Garden Grove, CA (US)

(72) Inventor: Armin Brown, Garden Grove, CA (US)

(73) Assignee: GOOFBOARD PRODUCTS, LLC, Garden Grove, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/685,301

(22) Filed: Apr. 13, 2015

(65) Prior Publication Data

US 2015/0306452 A1 Oct. 29, 2015

Related U.S. Application Data

(63) Continuation of application No. 14/519,069, filed on Oct. 20, 2014, now Pat. No. 9,005,091, which is a continuation of application No. 14/024,505, filed on Sep. 11, 2013, now Pat. No. 8,864,639, which is a continuation-in-part of application No. 13/429,310, filed on Mar. 23, 2012, now Pat. No. 8,758,206.

(51) Int. Cl.

| | |
|---|---|
| ***A63B 22/14*** | (2006.01) |
| ***A63B 22/16*** | (2006.01) |
| ***A63B 69/00*** | (2006.01) |
| ***A63B 26/00*** | (2006.01) |

(52) U.S. Cl.

CPC ..... *A63B 22/16* (2013.01); *A63B 26/003* (2013.01); *A63B 69/0093* (2013.01)

(58) Field of Classification Search

CPC ... A63B 22/16; A63B 69/0093; A63B 26/003
USPC ..... 482/51, 143, 146, 147; 441/74
See application file for complete search history.

(56) References Cited

U.S. PATENT DOCUMENTS

| | | | |
|---|---|---|---|
| 3,863,915 | A | 2/1975 | Pifer |
| 4,601,469 | A | 7/1986 | Sasser, Jr. |
| 4,817,950 | A | 4/1989 | Goo |
| 4,966,364 | A | 10/1990 | Eggenberger |
| 5,062,629 | A | 11/1991 | Vaughan |
| 5,399,140 | A | 3/1995 | Klippel |
| 5,509,871 | A | 4/1996 | Giovanni |
| 5,545,115 | A | 8/1996 | Corcoran |
| 5,897,474 | A | 4/1999 | Romero |
| 6,017,297 | A | 1/2000 | Collins |
| 6,666,797 | B1 | 12/2003 | Martin |
| 6,916,276 | B1 | 7/2005 | Robinson |
| 7,479,097 | B2 | 1/2009 | Rosborough et al. |
| 7,488,177 | B2 | 2/2009 | Pearson |
| 7,775,952 | B1 | 8/2010 | Curran et al. |

(Continued)

*Primary Examiner* — Glenn Richman
(74) *Attorney, Agent, or Firm* — Mintz Levin Cohn Ferris Glovsky and Popeo, P.C.

(57) ABSTRACT

A balance board adapted for riding rail-to-rail, preferably so that at least a portion of a rider's feet will be placed on the board over the elongated roller. The balance board includes an elongated, planar board having a length that exceeds a width. The balance board further includes two pair of stops mounted to an underside of the board, each pair of stops being mounted near opposite ends of the board, and each stop of the pair of stops being mounted near opposite sides of the board. The balance board further includes a traction region between each stop of each pair of stop.

15 Claims, 5 Drawing Sheets

(56) References Cited

U.S. PATENT DOCUMENTS

| | | | | |
|---|---|---|---|---|
| 7,811,217 | B2 | 10/2010 | Odien | |
| 7,857,740 | B2 | 12/2010 | Suaste | |
| 8,142,305 | B2 * | 3/2012 | Hackenberg | 473/278 |
| 8,460,161 | B2 * | 6/2013 | Cole et al. | 482/52 |
| 8,734,308 | B1 * | 5/2014 | Joslin | 482/146 |
| 8,758,206 | B2 | 6/2014 | Brown | |
| 8,864,639 | B2 | 10/2014 | Brown | |
| 8,888,669 | B2 * | 11/2014 | Dunegan | 482/146 |
| 9,005,091 | B2 | 4/2015 | Brown | |
| 2007/0184940 | A1 | 8/2007 | Tomes | |
| 2012/0270193 | A1 | 10/2012 | Piercey | |
| 2014/0309093 | A1 | 10/2014 | Brown | |
| 2015/0328498 | A1 | 11/2015 | Brown | |

* cited by examiner

SURFBOARD REPLICATING BALANCE BOARD SYSTEM

CROSS-REFERENCE TO RELATED APPLICATIONS

This application is a Continuation of U.S. patent application Ser. No. 14/519,069, filed Oct. 20, 2014, titled, "Surfboard Replicating Balance Board System," which is a Continuation of U.S. patent application Ser. No. 14/024,505, now U.S. Pat. No. 8,864,639, filed Sep. 11, 2013, titled "Surfboard Replicating Balance Board System," which in turn is a Continuation-in-Part of U.S. patent application Ser. No. 13/429,310, now U.S. Pat. No. 8,758,206, filed on Mar. 23, 2012, entitled "Surfboard Replicating Balance Board System," the entire disclosure of each of the aforementioned applications are hereby incorporated by reference herein.

BACKGROUND

This document relates to balance boards, and more particularly to a balance board system in which a board is balanced on a tube in parallel longitudinal axes.

Balance boards are used to develop fine motor skill and balance in humans. Balance boards typically include an elongated board having a length that is greater than a width, and a pivot mechanism. Usually the pivot mechanism is a cylinder that can roll by rotating about a central roll axis, which defines the pivot axis of the board. Most balance boards are adapted for balancing by a rider in which the board is positioned with its length latitudinal or transverse to the longitudinal or roll axis of the cylinder being, i.e. in a "see-saw" manner. In this manner, a rider's feet are positioned spaced apart on either side of the cylinder, and typically cannot be placed on the board directly above the cylinder.

SUMMARY

This document describes a balance board system having an elongated board that has a length greater than a width, and an elongated tube that has a length over five times greater than a diameter of the tube. The length of the board is positioned substantially parallel or longitudinal to a roll axis of the elongated tube, to provide a pivot axis of the elongated board that is parallel with the roll axis of the elongated tube.

In one aspect, a balance board includes an elongated, planar board having a length that exceeds a width. The balance board further includes two pair of stops mounted to an underside of the board, each pair of stops being mounted near opposite ends of the board, and each stop of the pair of stops being mounted near opposite sides of the board. The balance board further includes a traction region between each stop.

In another aspect, a balance board system includes a rigid tube having a length, and an elongated, planar board having a width and a length that exceeds the width and which exceeds the length of the rigid tube. The elongated planar board includes two pair of stops mounted to an underside of the board, each pair of stops being mounted near opposite ends of the board, and each stop of the pair of stops being mounted near opposite sides of the board. The elongated, planar board further includes a traction region between each stop of each pair of stop, each traction region comprising a compressible layer of material applied on the bottom of the board.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a balance board system that replicates the sensation and movement of a surfboard as it planes on water, particularly the lateral or rail-to-rail movement of the surfboard that is transverse a length of the surfboard.

The balance board system includes a board, such as an elongated rigid board, and a roller, such as an elongated tube or cylindrical member. The board has a length that is greater than a width. The roller has a length that is over five times greater than a diameter of the roller. The board includes a nose, a tail, and left and right rails that define peripheral side edges of the board. The board is sized and adapted to be positioned substantially parallel or longitudinally to a roll axis of the roller, to provide a pivot axis of the board that is parallel with the roll axis of the roller. In this manner, the board can be pivoted longitudinally over the roller by a rider, or ridden to roll the roller under the board to keep the board substantially level, or any combination thereof. Further, in preferred implementations, at least a portion of a rider's feet will be placed directly above the roller. For example, in some implementations, a rider rocks back and forth laterally, and pivots on the longitudinal axis on the elongated board, of the board, while keeping his or her feet at least partially above the roller.

The board can include traction regions extending transversely on a bottom of the board near both the nose and the tail of the board, such that both transverse compressible regions press on the roller. The traction regions are each formed of a compressible, flexible, deformable and/or elastic material such as cork or similar material, to provide traction between the transverse or lateral movement of the board and the roller as it rolls, or between a rolling movement of the board and the roller that is substantially stationary. Additionally, the traction regions provide dampening or cushioning to the interface with the roller for a smooth ride. A pair of stops extends down from the bottom of the board, one stop on each of opposite sides of each traction region, to inhibit lateral movement of the board relative the roller beyond the stops. A top of the board includes gripping regions to provide gripping between a rider's feet and the top of the board.

Figures 1A, 1B, 2:
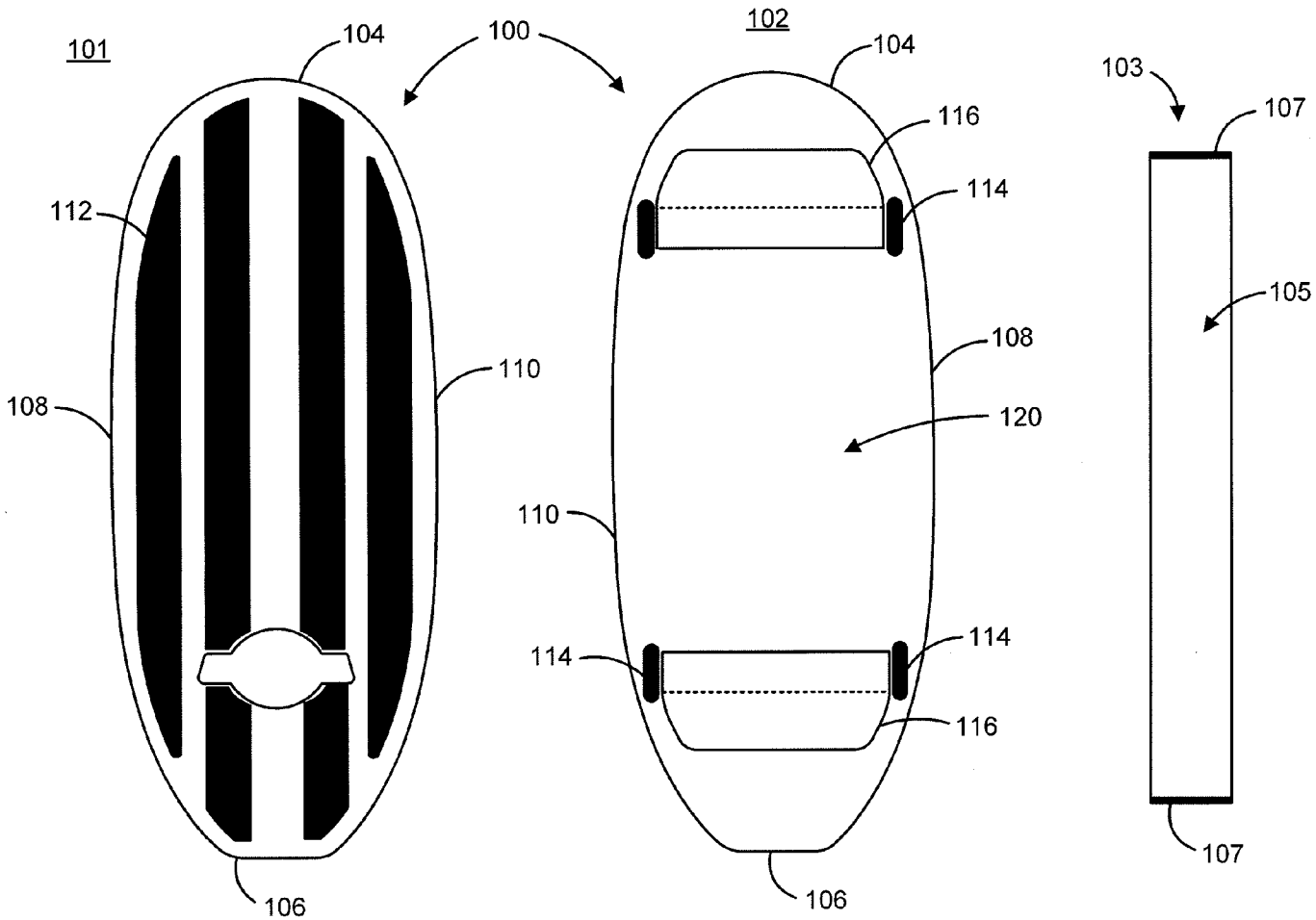
FIG. 1A shows a top of a board of a balance board system.
FIG. 1B shows a bottom of a board of a balance board system.
FIG. 2 illustrates a tube of a balance board system.

FIGS. 1A and 1B illustrate a respective top 101 and bottom 102 of a board 100 of a balance board system. The board 100 has a nose 104, a tail 106, a left rail 108 and a right rail 110. The nose 104 is preferably rounded or pointed, and the tail 106 is preferably truncated or flattened, such that the board 100 is asymmetric in a latitudinal axis that is transverse a longitudinal axis $\alpha_b$, to resemble a common surfboard aesthetic and to provide a rider with a sense of spatial direction when riding the board. The top 101 of the board 100 can also include a number of gripping regions 112. The gripping regions 112 can be formed of grip tape or similar surface. In some implementations, the gripping regions 112 are provided on the top 101 of the board 100 in a series of stripes, again to connote the common surfboard aesthetic, as well as provide suitable gripping surface coverage for a rider to be able to perform walks and tricks on the board 100.

The bottom 102 of the board 100 includes a traction region 116 formed on a surface of the bottom both near the nose 104 and near the tail 106 of the board. The traction regions 116 extend transversely across the bottom 102 of the board to opposing left and right rails 108, 110. Each traction region 116 is formed of a compressible, flexible, deformable and/or elastic material, to provide traction between the transverse or lateral movement of the board and the roller as it rolls, or between a rolling movement of the board and the roller when the roller is substantially stationary. In some implementations, each traction region 116 is formed of a thin layer of cork or other similar material. In these implementations, the layer of a cork is 0.5 to 5 mm thick or thicker, and preferably around 1.5 mm thick. Each traction region 116 can be a linear strip across the bottom 102 of the board 100, or, as illustrated in FIG. 1B, may extend forward and aft toward the respective nose 104 and tail 106 of the board, to provide greater traction and stability as the rider places his or her feet closer to the nose 104 or tail 106 of the board 100.

The bottom 102 of the board 100 further includes two or more pairs of stops 114. Each stop 114 of the pair of stops extend down from the bottom of the board, preferably near one of the nose 104 or tail 106, and one of the left rail 108 and right rail 110 of the bottom 102 of the board 100. In some implementations, the board 100 includes two pair of stops 114, each pair having one stop 114 proximate opposite sides or lateral ends of each traction region 116, to inhibit lateral movement of the board 100 relative the roller beyond the stops 114. Preferably, each stop 114 is mounted to the board 100 to extend from the bottom 102 at a small distance inset from the edge of the left and right rails 108 and 110, respectively, so that a maximum width of the board 100 extends beyond the stops 114.

FIG. 2 illustrates a roller 103, preferably having a cylindrical surface 105 that is capped at opposing distal ends 107. The roller 103 can be formed of a hard and rigid or semi-rigid material, such as dense cardboard, wood, plastic or carbon fiber, for example. In other implementations, the roller 103 can be formed of a material that provides limited flexibility. The roller 103 is formed to a length that is shorter than a length of a board 100, but long enough to mate against the traction regions 116 on the bottom 102 of the board 100. The board 100 and the roller 103 are adapted to be ridden on coincident longitudinal axes, $\alpha_b$, for the board 100, and $\alpha_r$ for the roller 103, as shown in FIG. 1A and FIG. 2. The roller 103 can also have any number of curvatures or non-linear surfaces along its length, leading to larger or smaller diameters.

The board 100 is preferably made of a hard, rigid and resilient material, such as wood, wood-ply, bamboo, or other natural material. In some implementations, the board 100 can be formed to have limited flexibility in one or more axes. In yet other implementations, the board 100 can be made of plastic, poly-vinyl carbonate, carbon fiber, or the like, or any combination thereof. Preferably, the board 100 has a density sufficient to weigh on roller 103 on which it is ridden, yet allow a particular freedom of movement.

To be properly adapted for balancing parallel to a roll axis of the roller, the board 100 requires some specific dimensions. Further, in order to closely replicate a real surfboard's movement, it has been determined that the board 100 requires a particular shape and look, in addition to the specific dimensions. In some implementations, a board 100 has a width of between 10 and 20 inches, and a length of between 30 and 60 inches. A roller 103 has a diameter of between 2 and 6 inches, and a length of between 25 and 50 inches. In a particular exemplary implementation, the board 100 has a width of 15 inches and a length of 44 inches, and the roller has a diameter of 4 inches and a length of 37 inches. In this particular implementation, traction regions 116 of the board 100 are approximately 10.875 inches in width, and the stops are approximately 3 inches in length while extending 0.5 to 1 inch from the rails 108 and 110 of the board 100. This particular implementation has unexpected results of most closely replicating a rolling action of a real surfboard that planes on water, while allowing a rider to perform tricks such as walking, "hanging ten" or other surf-oriented maneuvers.

Figure 3B:
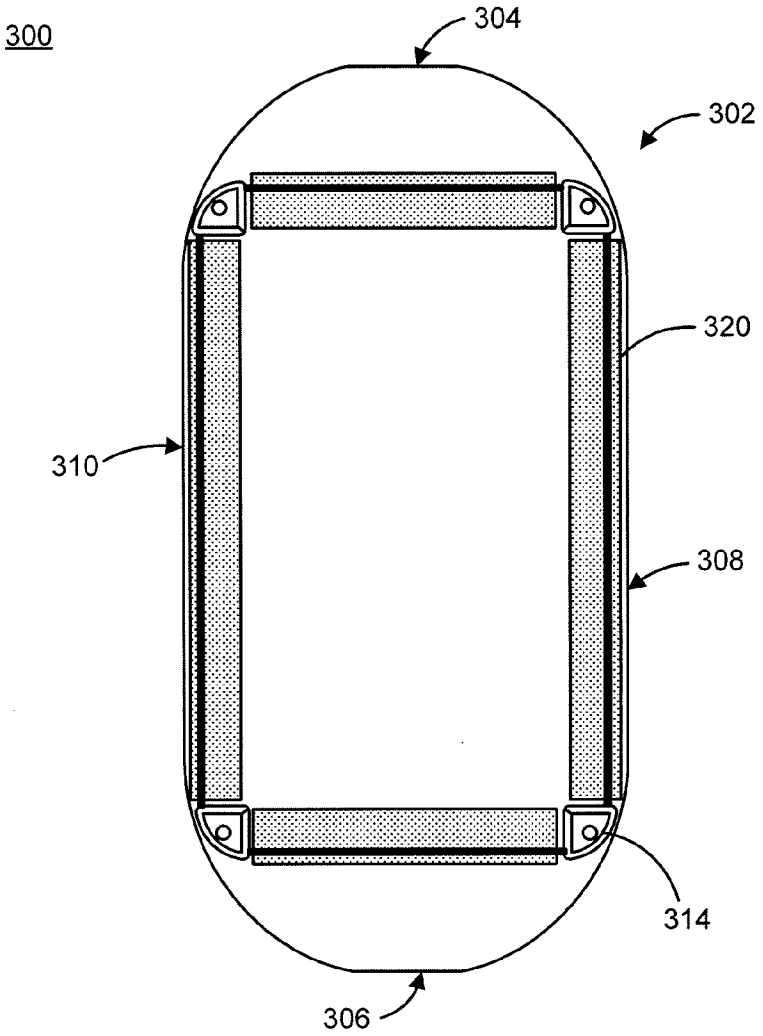
FIG. 3B shows a bottom of a board of a balance board system.
Figure 3A:
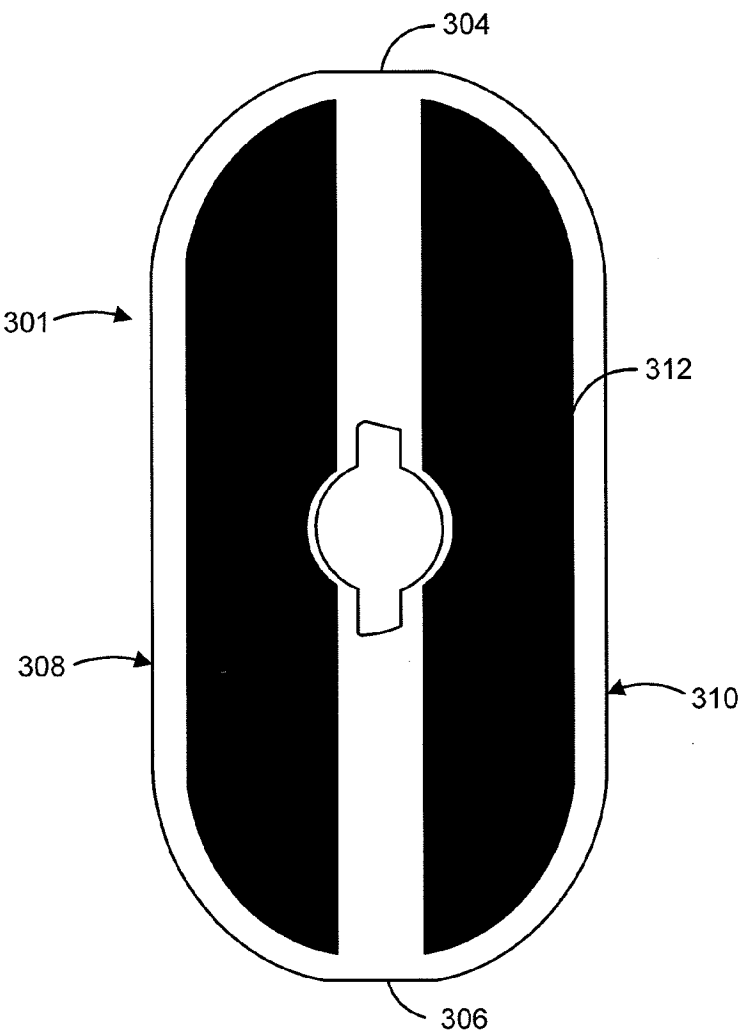
FIG. 3A shows a top of a board of a balance board system.

In accordance with an alternative implementation of a balance board system, FIGS. 3A and 3B illustrate a respective top 301 and bottom 302 of a board 300. The top 301 and bottom 302 of the board 300 each has a surface area defined by a nose 304, a tail 306, a left rail 308 and a right rail 310. The left rail 308 and right rail 310 are connected between the nose 304 and tail 306 by curved portions, which can form part of the left and right rails 308 and 310, respectively. The top 301 of the board 300 can include a number of gripping regions 312, as substantially described above for gripping regions 112 of FIG. 1A.

In some implementations, the length of the board 300 is between 24 and 36 inches, and preferably between 28 and 32 inches. In other implementations, the length of the board 300 is between 10 and 120 inches, or more. The bottom 302 and/or top 301 of the board can be flat, or can have some curvature. The curvature can include a rocker, i.e. a curvature along the longitudinal axis $\alpha_b$ to provide concavity lengthwise with respect to the top 301 of the board 300. The curvature can also include one or more curvatures along a latitudinal axis to provide respective one or more curvatures widthwise with respect to the bottom 302 of the board 300. Further, the curvature can include any number of curvatures or concavities with respect to the top 301 and or bottom 302 of the board 300.

The left rail 308 and right rail 310 of the board 300 are preferably parallel for at least a portion of a length of the board (i.e. a length between the nose 304 and the tail 306), such that a major surface area of the board 300 is linear, and can accommodate a sideways stance of a rider, similar to a surfboard, skateboard, or the like. The parallel portions of the left and right rails 308 and 310 can be bounded on the bottom 302 by stops 314, which align to define the corners of a rectangular area. The stops 314 are configured and shaped for being bi-directional stops for a board 300 that rolls on a roller, providing a stop to a rolling or rocking motion either longitudinally or transversely (respectively: rail-to-rail or nose-to-tail). Implementations of the stops 314 are described in further detail below.

The balance board system can further include an elastic tubing 320 or cylindrical elastic band that is stretched and/or held in place by the stops 314. The elastic tubing 320 can be hollow or solid, and can act as a further friction bearing member for dampening or inhibiting the relative rolling velocity between the board 300 and a roller. The elastic tubing 320 can have any cross-sectional shape, durometer, or pliability, and can be formed of any of a number of elastomers providing any degree of elasticity. Further, the elastic tubing 320 can be provided with a ring, a band, a mark, or other demarcation that a user can use to properly position or orientate the elastic tubing 320 around the stops 314 and relative to the board 300. For instance, in one implementation the elastic tubing 320 can have a band at a location along the tubing, and the user can provide the band to one of the stops 314 when mounting the elastic tubing to the balance board.

In between the stops 314, in the lateral and/or longitudinal direction, the bottom 302 includes traction regions 316, which extend transversely across at least part of the bottom 302 of the board 300 between opposing left and right rails 308, 310, and/or longitudinally across at least part of the bottom 302 of the board 300 substantially along each of the left and right rails 308 and 310. Each traction region 316 can be formed of a compressible, flexible, deformable and/or elastic material, to provide traction between the transverse or lateral movement of the board and the roller as it rolls, or between a rolling movement of the board and the roller when the roller is substantially stationary. In some implementations, each traction region 316 is formed of a thin layer of cork or other similar material. In these implementations, the layer of a cork is 0.5 to 5 mm thick or thicker, and preferably around 1.5 mm thick. As discussed above, each traction region 316 can be a linear strip across the bottom 302 of the board 300 as shown in FIG. 3B, or, as illustrated in FIG. 1B, may extend in any direction along the bottom 302 to provide greater traction and stability for the rider in any orientation.

In some implementations, as shown in FIG. 3B, four stops 314 define corners of a substantially rectangular bottom surface on the bottom 302 of the board 300, which contacts a roller on which the board 300 is ridden, and strips of traction regions 316 define sides of a rectangular or peripheral regions of the substantially rectangular surface. Accordingly, the four stops 314 in such an arrangement allow the board 300 to be ridden in either orientation: rolling or rocking motion either longitudinally or transversely (respectively: rail-to-rail or nose-to-tail), or alternated thereof. Additionally, particularly when riding a roller that is transverse to the longitudinal axis of the board 300, the friction dynamic of the traction regions 316 along the rails, or even the absence of any friction by non-inclusion of the traction regions 316, can allow for significant yaw, or twisting or pivoting about a vertical axis.

In alternative implementations, less than four stops 314 can be used. The stops 314 can be squared, triangular, or curved, and may have one or more straight edges and/or one or more curved edges. Each stop can include an outwardly extending ridge to define a sideway-facing channel for receiving and holding a part of the elastic tubing 320.

Figure 4:
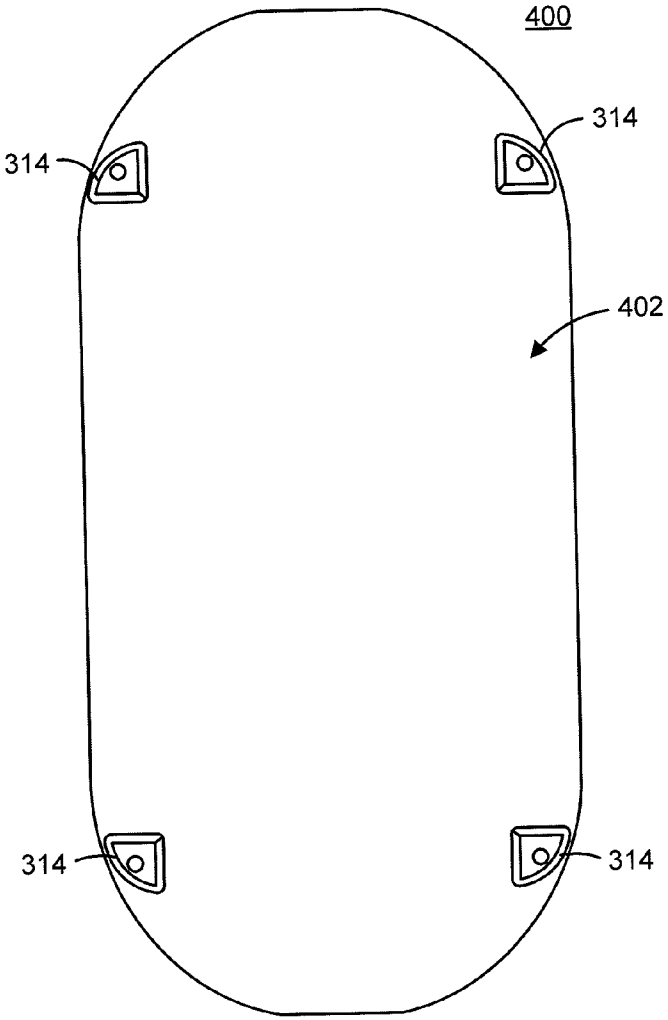
FIG. 4 shows a bottom of a board of a balance board system in accordance with an alternative implementation.

FIG. 4 shows a bottom 402 of a board 400 of a balance board system in accordance with an alternative implementation, in which the surface of the bottom 402 is free of any traction regions or other higher-friction bearing surfaces. Accordingly, the bottom 402 of the board 400 is preferably smooth and free of any rough surfaces, protrusions, or the like. The board 400 can also include the stops 314, positioned as described above, to allow the board 400 to be ridden on a roller either longitudinally or latitudinally.

Figure 5:
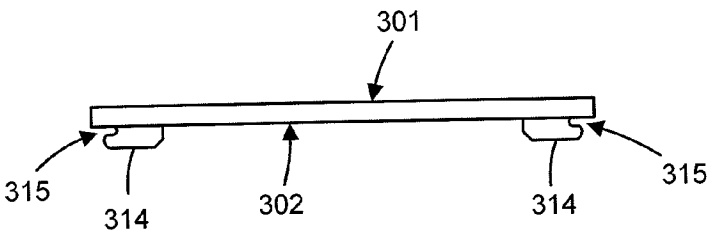
FIG. 5 is a front or rear view of a balance board.

FIG. 5 is a front or rear view of a balance board showing a top 301, a bottom 302 and side rails of the board. Two or more stops 314 are attached to an underside, or bottom 302, of the board.

Figure 6B:
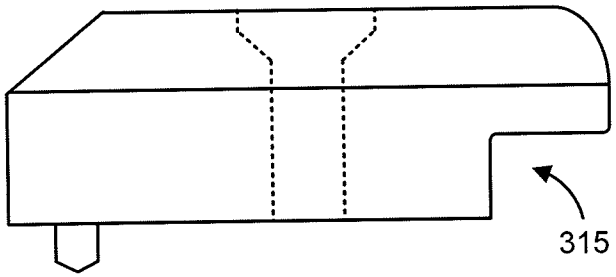
FIG. 6B shows a side view of a bi-directional stop for use with a board of a balance board system.
Figure 6A:
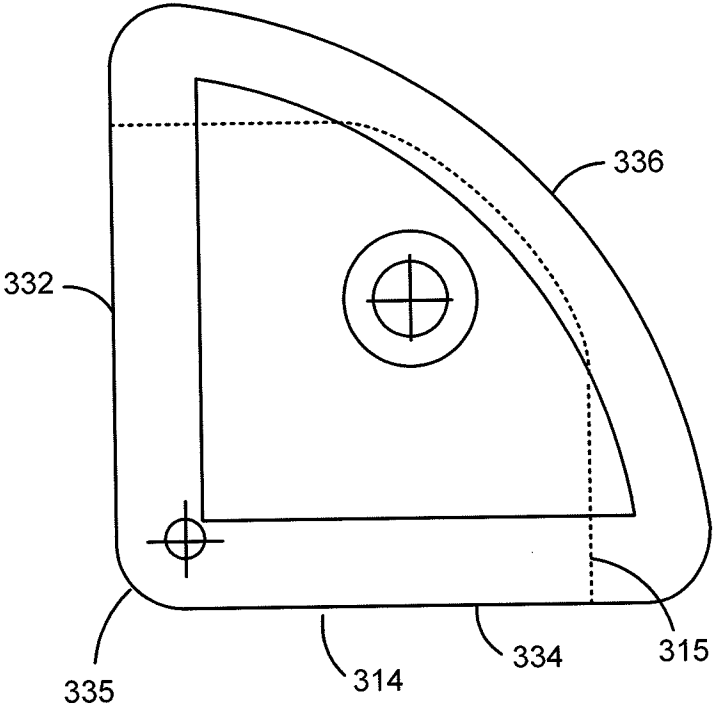
FIG. 6A shows a top view of a bi-directional stop for use with a board of a balance board system.

FIGS. 6A and 6B show a top view and side view, respectively, of a bi-directional stop 314 that can be used with a board of a balance board system as described herein. In some implementations, each stop 314 includes a first straight edge 332, a second straight edge 334 approximately 90 degrees from the first straight edge 332, and a curved edge 336 between the first straight edge 332 and second straight edge 334 opposite a corner 335 connecting the first straight edge 332 and second straight edge 334. In other implementations, each stop can be triangular with three straight edges, to maximize yield of a solid sheet of material to be machined into the stops.

The stop 314 includes a ridge 315 that forms a groove or channel in which an elastic tubing or the like can be placed. The ridge 315 can extend along an entire length of the curved edge 336 (or hypotenuse) and to at least part of the first straight edge 332 and second straight edge 334.

Figure 7:
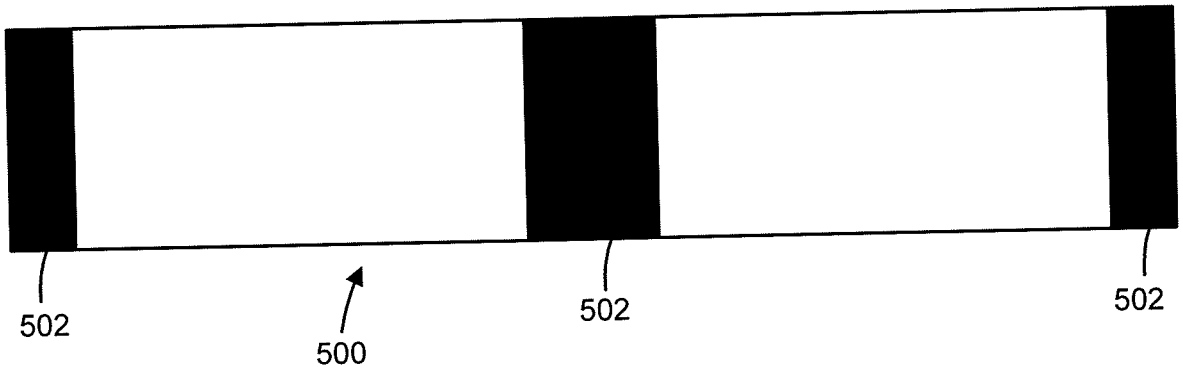
FIG. 7 shows a grip surface implemented as one or more bands around a roller.

FIG. 7 shows a roller 500. The roller 500 can have a cylindrical, or tube, shape, and can be hollow or solid. The roller 500 can also have a dynamic curvilinear shape, i.e. a set of rounded peaks and curved valleys, or rounded corners, if desired. If hollow, the roller 500 can include a cap on each side to enclose the roller 500. The roller 500 can have one or more bands of grip surface 502. The grip surface 502 can include grip tape, an adhesive, or a sprayed-on layer having a friction forming material, or the like. The grip surface 502 can be implemented as one or more bands around the roller 500, such as around the middle and/or around ends of the roller, as shown in FIG. 7, or covering some or all of the outer surface of the roller 500.

Figure 8:
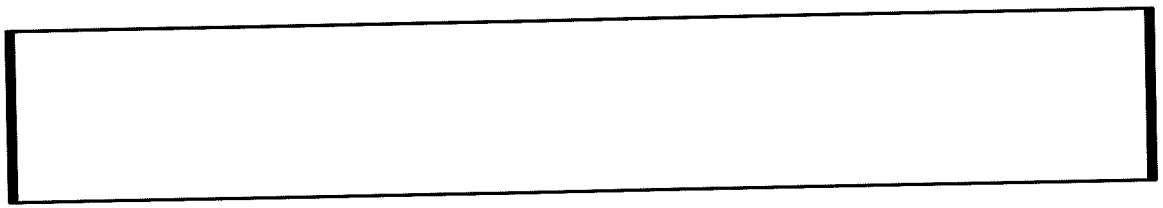
FIG. 8 shows a roller that is free of additional grip surfaces.

FIG. 8 shows a roller 600 that is free of additional grip surfaces, and is preferably relatively smooth and low-friction. The roller 600 can also be hollow or solid, and can have a cylindrical or tubular shape, or other shape as described above with respect to the roller 500.

Although a few embodiments have been described in detail above, other modifications are possible. Other embodiments may be within the scope of the following claims.

The invention claimed is:

1. A balance board comprising:

a board that has a length that exceeds a width, the board having a top surface and a bottom surface, the top surface and bottom surface being defined by a nose, a tail and left and right rails;

four stops mounted to bottom surface of the board, each stop in a first pair of stops being mounted toward the nose of the board and proximate one of the left or right rails, and each stop in a second pair of stops being mounted toward the tail of the board proximate one of the left or right rails;

a traction region on the top side of the board; and an elongated roller that is detached from the board, the elongated roller providing longitudinal rolling support for the board between the left and right rails of the board in a rail to rail rolling mode, or for latitudinal support for the board between the nose and tail of the board in a nose to tail rolling mode.

2. A balance board in accordance with claim 1, wherein each stop includes at least one curved edge.

3. A balance board in accordance with claim 1, wherein each stop has a length that exceeds a width.

4. A balance board in accordance with claim 1, wherein the board is formed of wood.

5. A balance board in accordance with claim 1, wherein the four stops are mounted at respective corners of a rectangular area of the bottom surface.

6. A balance board comprising:

a board that has a length that exceeds a width, the board having a top surface and a bottom surface, the top surface and bottom surface being defined by a nose, a tail and left and right rails;

four stops mounted to bottom surface of the board, a first pair of stops being mounted toward the nose of the board and proximate one of the left or right rails, and a second pair of stops being mounted toward the tail of the board proximate one of the left or right rails;

a traction region on the top side of the board; and an elongated roller that is detached from the board, the elongated roller providing longitudinal rolling support for the board between the left and right rails of the board in a rail to rail rolling mode, or for latitudinal support for the board between the nose and tail of the board in a nose to tail rolling mode.

7. A balance board in accordance with claim 6, wherein each stop includes at least one curved edge.

8. A balance board in accordance with claim 6, wherein each stop has a length that exceeds a width.

9. A balance board in accordance with claim 6, wherein the board is formed of wood.

10. A balance board in accordance with claim 6, wherein the four stops are mounted at respective corners of a rectangular area of the bottom surface.

11. A balance board comprising:

a board that has a length that exceeds a width, the board having a top surface and a bottom surface, the top surface and bottom surface being defined by a nose, a tail and left and right rails, the top surface being substantially planar;

four stops mounted to bottom surface of the board, a first pair of stops being mounted toward the nose of the board and proximate one of the left or right rails, and a second pair of stops being mounted toward the tail of the board proximate one of the left or right rails;

a traction region on the top side of the board; and an elongated roller that provides a rolling interface for the board in any of a plurality of rolling modes, the plurality of rolling modes including a rail to rail rolling mode of the elongated roller supporting the board in the rolling interface between the left and right rails of the board, and a nose to tail rolling mode supporting the board in the rolling interface between the nose and tail of the board.

12. A balance board in accordance with claim 11, wherein each stop includes at least one curved edge.

13. A balance board in accordance with claim 11, wherein each stop has a length that exceeds a width.

14. A balance board in accordance with claim 11, wherein the board is formed of wood.

15. A balance board in accordance with claim 11, wherein the four stops are mounted at respective corners of a rectangular area of the bottom surface.

* * * * *